US007634908B2

(12) United States Patent
Chu

(10) Patent No.: US 7,634,908 B2
(45) Date of Patent: Dec. 22, 2009

(54) EXHAUST SYSTEM

(75) Inventor: Dong Ho Chu, Gyunggi-Do (KR)

(73) Assignee: Hyundai Motor Company, Seoul (KR)

( * ) Notice: Subject to any disclaimer, the term of this patent is extended or adjusted under 35 U.S.C. 154(b) by 161 days.

(21) Appl. No.: 11/600,502

(22) Filed: Nov. 15, 2006

(65) Prior Publication Data

US 2008/0047262 A1 Feb. 28, 2008

(30) Foreign Application Priority Data

Aug. 24, 2006 (KR) ..... 10-2006-0080669

(51) Int. Cl.
*F01N 7/10* (2006.01)

(52) U.S. Cl. ..... 60/323; 60/272; 60/305; 60/313; 123/65 EM; 123/184.41; 123/193.5; 123/671

(58) Field of Classification Search ..... 60/272, 60/305, 312, 313, 314, 322, 323, 324; 123/41.69, 123/65 EM, 193.5, 184.33, 184.41, 671
See application file for complete search history.

(56) References Cited

U.S. PATENT DOCUMENTS

| | | | | | |
|---|---|---|---|---|---|
| 2,664,864 | A * | 1/1954 | Ernest | 123/184.39 |
| 2,689,451 | A * | 9/1954 | Froehlich | 60/323 |
| 2,926,647 | A * | 3/1960 | Welch | 123/547 |
| 5,072,583 | A * | 12/1991 | Urushihara et al. | 60/313 |
| 5,689,954 | A * | 11/1997 | Blocker et al. | 60/322 |
| 5,887,428 | A * | 3/1999 | Garisto | 60/323 |
| 6,321,532 | B1 * | 11/2001 | Komush | 60/313 |
| 6,564,767 | B1 * | 5/2003 | Reese | 123/184.53 |
| 6,761,239 | B2 * | 7/2004 | Kawamoto | 180/219 |
| 6,990,806 | B1 * | 1/2006 | Kinsel | 60/321 |

* cited by examiner

*Primary Examiner*—Binh Q. Tran
(74) *Attorney, Agent, or Firm*—Edwards Angell Palmer & Dodge LLP

(57) ABSTRACT

Disclosed is an exhaust system for discharging combusted gases from the cylinder of a vehicle engine, which comprises an exhaust manifold with a plurality of exhaust gas runners, wherein the exhaust gas runners are spaced so as to avoid an exhaust gas interference.

8 Claims, 4 Drawing Sheets

EXHAUST SYSTEM

CROSS-REFERENCE TO RELATED APPLICATION

This application claims priority to and the benefit of Korean Patent Application No. 10-2006-0080669 filed in the Korean Intellectual Property Office on Aug. 24, 2006, the entire contents of which are incorporated herein by reference.

BACKGROUND OF THE INVENTION (a) Field of the Invention

The present invention relates to an exhaust system. More particularly, the present invention relates to an exhaust system reducing interference between exhaust gases.

(b) Description

Generally, a vehicle engine includes an exhaust system to discharge exhaust gases out of the vehicle.

A vehicle engine has a cylinder bank including a predetermined number of cylinders. An engine having cylinders disposed in a V-shape is called a V-shape engine.

If the bank includes four cylinders, the engine is called a V-8 type engine.

FIG. 1 shows an exhaust manifold of an exhaust system according to the prior art. Specifically, FIG. 1 shows an exhaust manifold mounted to a cylinder bank of a V-8 type engine.

FIG. 2 shows a V-8 type cylinder bank that is generally connected to an exhaust system. As shown in FIG. 2, the V-8 type engine includes two cylinder banks 201 and 202, and combustions in the four cylinders included in one of the cylinder banks 201 occur sequentially in the order of the numbers shown in FIG. 2.

Generally, the exhaust manifold shown in FIG. 1 is called a 4-1 type exhaust manifold.

In the 4-1 type exhaust manifold, a first exhaust gas runner 101 is connected to a second exhaust gas runner 103, and the second exhaust gas runner 103 is connected to a main exhaust gas runner 105.

Therefore, the exhaust gas is discharged out of a vehicle by sequentially passing the first, second, and main exhaust gas runners 101, 103, and 105.

While this type of manifold has a simple structure, it gives rise to a problem that overall performance of the engine can be reduced by gas interference between the runners.

Alternatively, a 4-2-1 type exhaust manifold has been developed. In this type of exhaust manifold, two of the four first exhaust gas runners are connected to one second exhaust gas runner, and two of such second exhaust gas runners can be disposed.

The 4-2-1 type exhaust manifold, however, has a drawback that it is hard to be mounted on a V-8 type engine because the angle between the two banks of the V-8 type engine is 90°. As a result, the manufacture is more difficult and the manufacturing cost is higher.

An additional drawback is increased heat release caused by increased area of the exhaust manifold.

There is thus a need for an improved exhaust system that can prevent a gas interference with simple scheme and reduce the amount of heat release.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

In one aspect, the present invention provides an exhaust system for discharging combusted gases from the cylinder of a vehicle engine, which comprises an exhaust manifold with a plurality of exhaust gas runners, wherein the exhaust gas runners are spaced so as to avoid an exhaust gas interference.

In another aspect, motor vehicles are provided that comprise a described exhaust system.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present exhaust systems will be particularly useful with a wide variety of motor vehicles.

Other aspects of the invention are discussed infra.

Figure 1A:
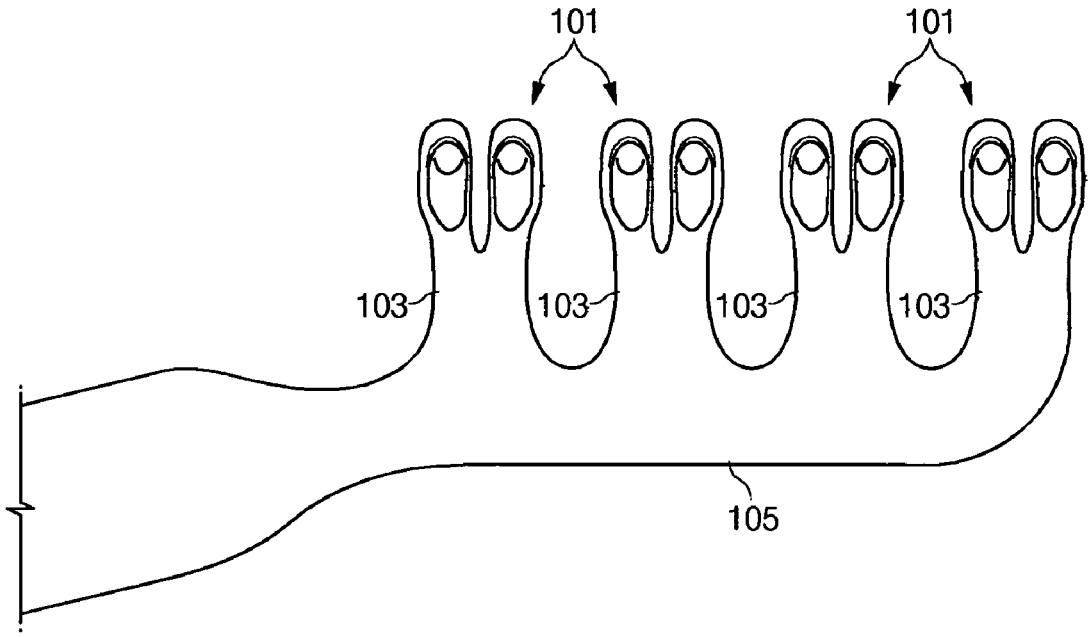
FIG. 1 shows an exhaust manifold of an exhaust system according to the prior art.
Figure 1B:
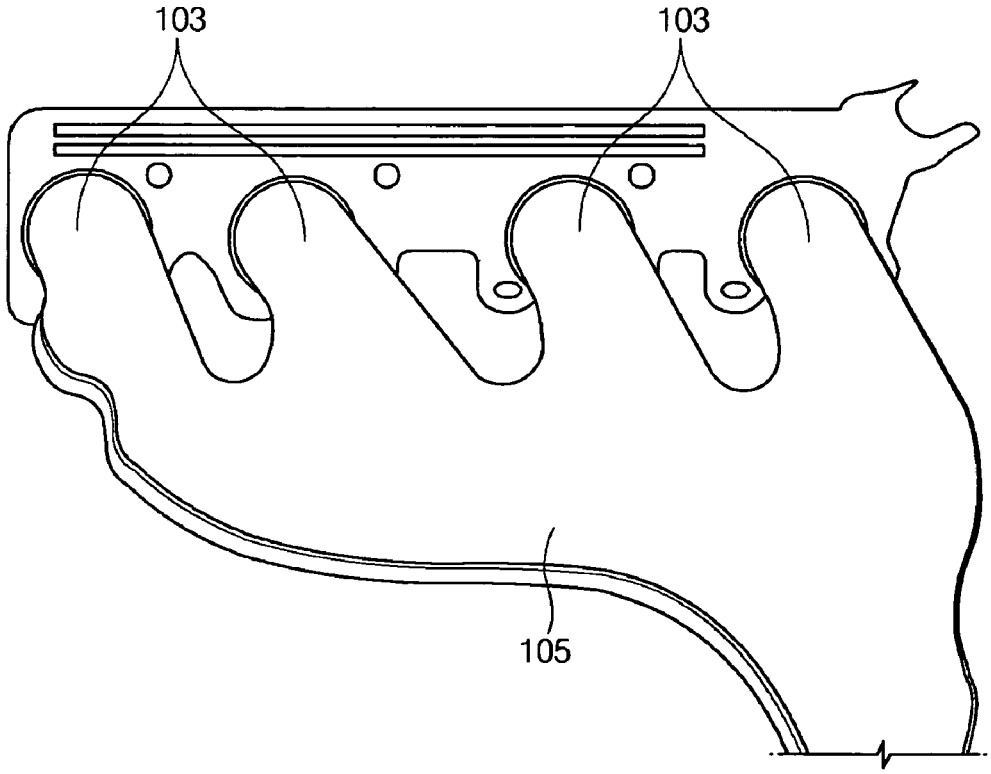

Reference numerals set forth in the Drawings includes reference to the following elements as further discussed below:

301: first exhaust gas runner (exhaust-gas runner)
303: second exhaust gas runner
305: third exhaust gas runner
307: cylinder head (cylinder head)

DETAILED DESCRIPTION

In one aspect, as discussed above, the present invention provides an exhaust system for discharging combusted gases from the cylinder of a vehicle engine, which comprises an exhaust manifold with a plurality of exhaust gas runners, wherein the exhaust gas runners are spaced so as to avoid an exhaust gas interference.

Preferably, at least one part of the plurality of exhaust gas runners may be formed inside the cylinder head. More preferably, all of the exhaust gas runners may be formed inside the cylinder head.

A preferred exhaust system may have a exhaust manifold comprising (a) at least one first exhaust gas runner connected to a corresponding exhaust valve; (b) at least one second exhaust gas runner connected to at least one first exhaust gas runner; and (c) at least one third exhaust gas runner connected to at least one second exhaust gas runner.

In such system, second exhaust gas runner may preferably be connected with two first exhaust gas runners. Each third exhaust gas runner may also preferably be connected with two second exhaust gas runners.

Suitably, at least one of the first, second, and third exhaust gas runners may be formed in the cylinder head. More suitably, all of the first, second, and third exhaust gas runners may be formed in the cylinder head.

In a preferred embodiment, exhaust systems may further comprise at least one auxiliary exhaust gas runner. For instance, such auxiliary exhaust gas runner may preferably be formed by connecting two first exhaust gas runners.

Preferably, each second exhaust gas runner may be connected to at least one auxiliary exhaust gas runner. More preferably, each second exhaust gas runner may be connected to two auxiliary exhaust gas runners.

Also preferably, each third exhaust gas runner may be connected to two second exhaust gas runners.

In another aspect, the present invention provides motor vehicles comprising the exhaust system as described above.

Reference will now be made in detail to the preferred embodiment of the present invention, examples of which are illustrated in the drawings attached hereinafter, wherein like reference numerals refer to like elements throughout. The embodiments are described below so as to explain the present invention by referring to the figures.

Figure 2:
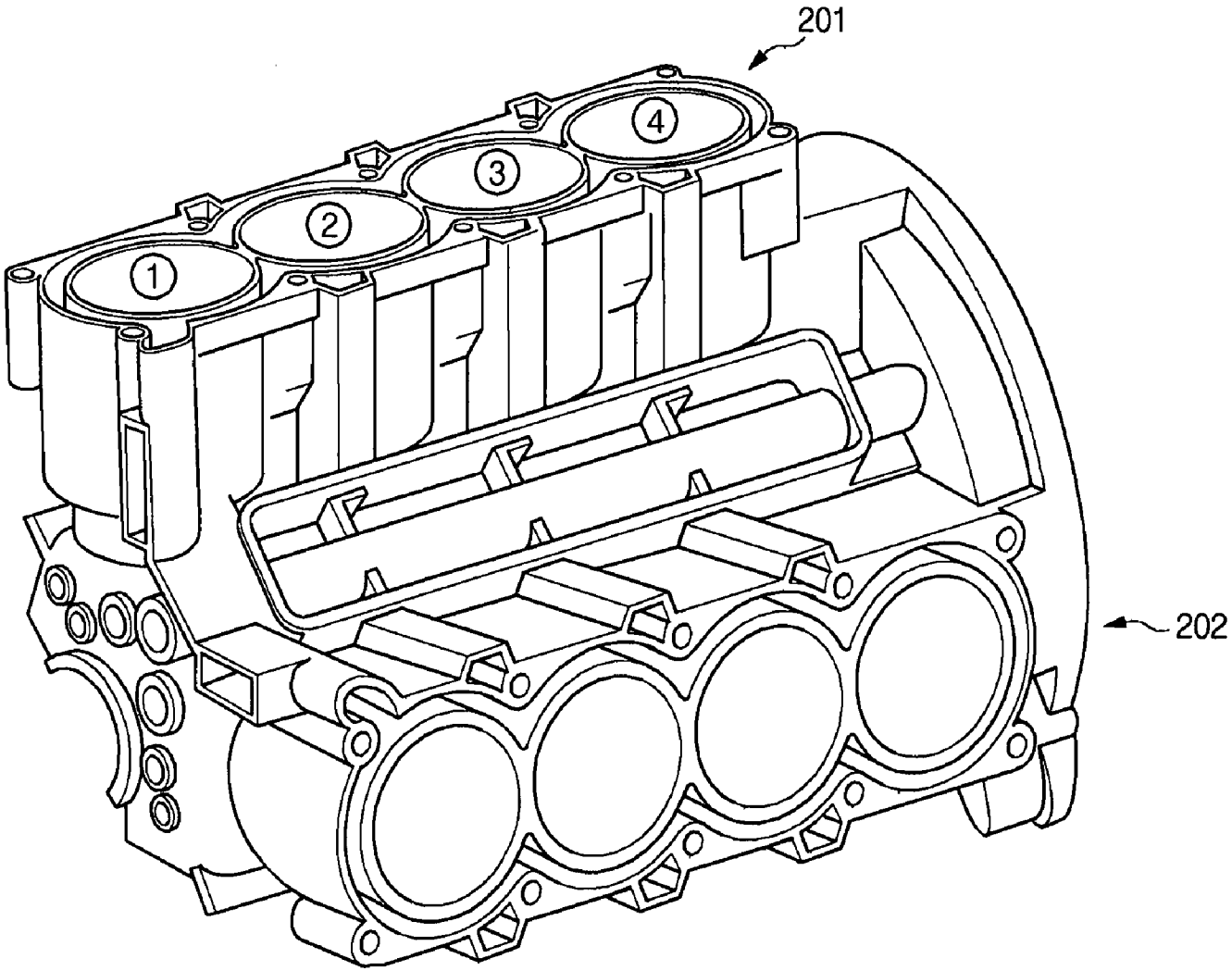
FIG. 2 shows a V-8 type cylinder bank that is generally connected to an exhaust system.
Figure 3:
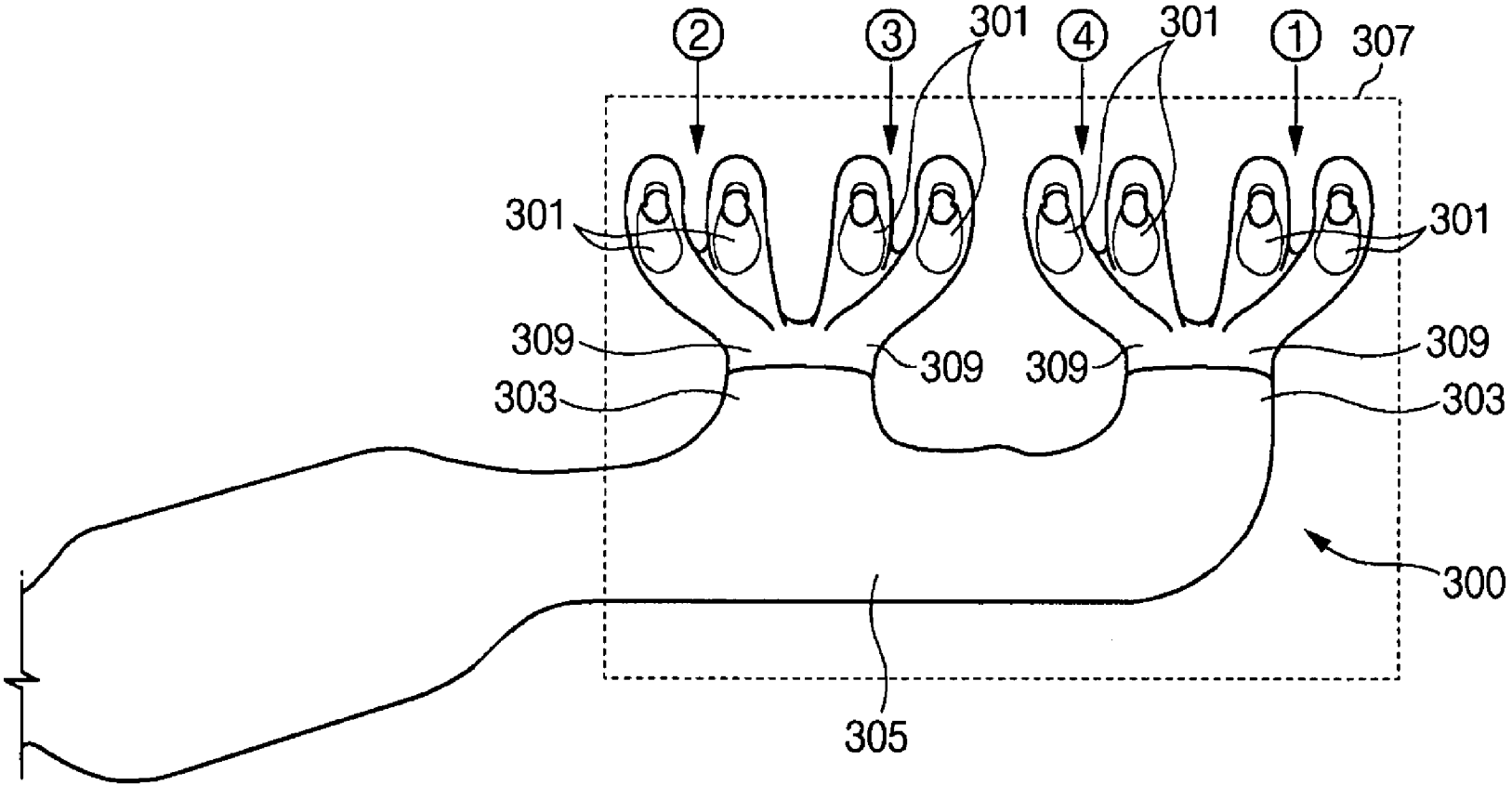
FIG. 3 shows an exhaust manifold of an exhaust system according to an exemplary embodiment of the present invention.
Figure 4:
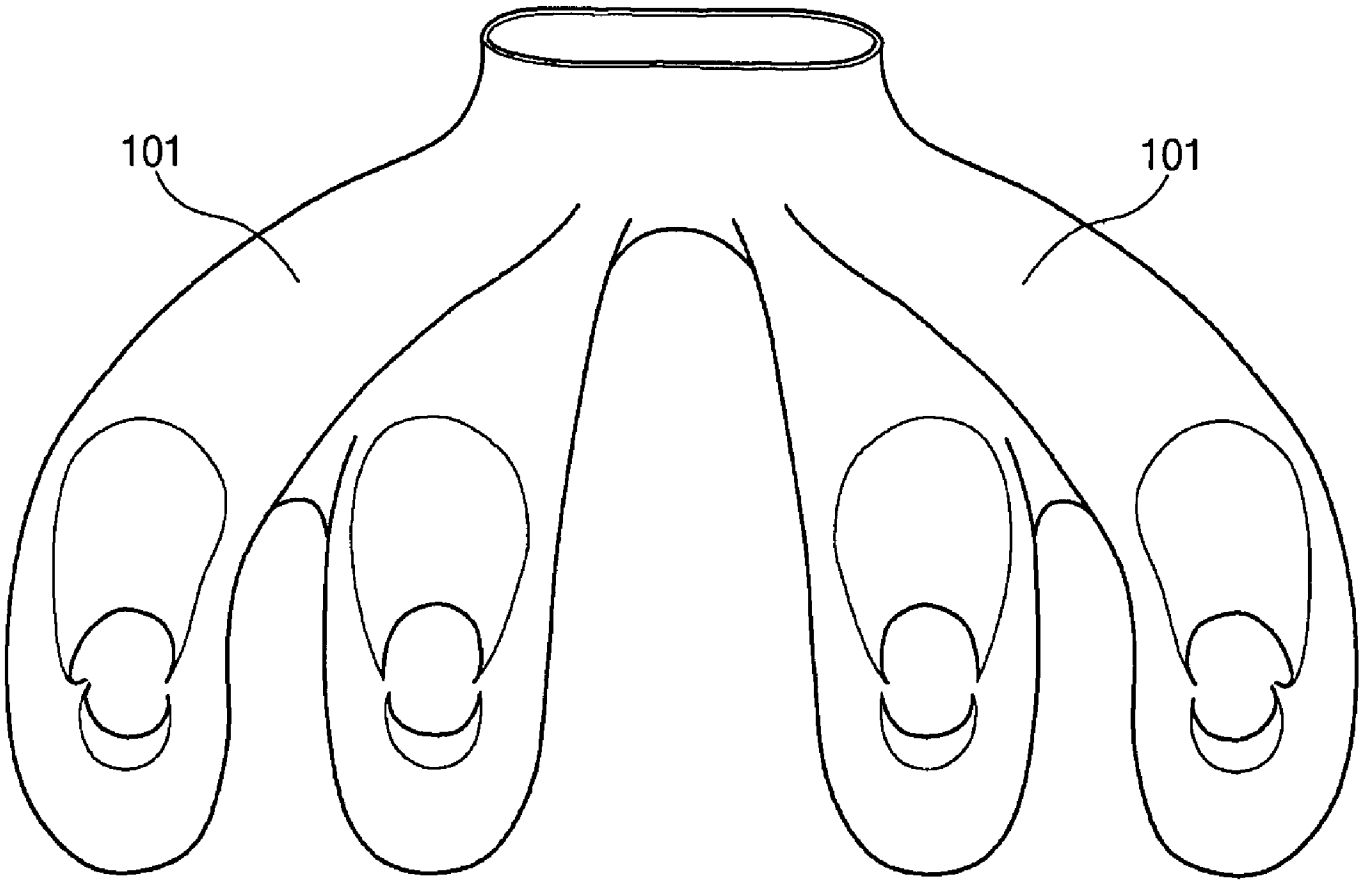
FIG. 4 shows a first exhaust gas runner of an exhaust manifold according to an exemplary embodiment of the present invention.

FIG. 2 shows a V-8 type cylinder bank that is generally connected to an exhaust system, FIG. 3 shows an exhaust manifold of an exhaust system according to an exemplary embodiment of the present invention, and FIG. 4 shows a first exhaust gas runner of an exhaust manifold according to an exemplary embodiment of the present invention.

As shown in FIG. 2, generally, a V-8 type cylinder bank mounted to the exhaust system includes a first cylinder bank 201 and a second cylinder bank 202.

In addition, in the cylinders of the first cylinder bank 201, combustions occur sequentially corresponding to the numbers shown in FIG. 2.

In a preferred embodiment, exhaust systems of the present invention are illustrated to be applied to a Double-Overhead camshaft (DOHC) engine, but the application of the exhaust systems is not limited to DOHC engine only.

As shown in FIG. 3, according to an exemplary embodiment of the present invention, an exhaust system includes an exhaust manifold 300.

The exhaust manifold 300 is connected to the cylinder head 307 in order to discharge exhaust gases combusted in the cylinder of the engine.

According to an exemplary embodiment of the present invention, at least one part of the exhaust manifold 300 may be formed in the cylinder head such that the exhaust gas can be discharged.

In addition, the exhaust gas runner may include at least one first exhaust gas runner 301 connected to each exhaust valve, at least one second exhaust gas runner 303 connected to at least one first exhaust gas runner 301, and at least one third exhaust gas runner 305 connected to at least one second exhaust gas runner 303.

Each second exhaust gas runner 303 may be connected to two first exhaust gas runners 301, and each third exhaust gas runner 305 may be connected to two second exhaust gas runners 303.

Referring to FIG. 3 and FIG. 4, according to an exemplary embodiment of the present invention, each first exhaust gas runner 301 of the exhaust manifold 300 may be connected to an exhaust valve (not shown).

Preferably, two first exhaust gas runners 301 may be connected to a second exhaust gas runner 303. As a result, the space between the second exhaust gas runners 303 can be further widened, thereby preventing interference between the exhaust gases.

In addition, the number of second exhaust gas runners 303 may preferably be reduced to two and the entire area of the exhaust manifold can be reduced. Therefore, the heat transfer area of the exhaust manifold can be reduced, thereby reducing the amount of heat release from the exhaust manifold.

Preferably, exhaust systems of the present invention may further include at least one auxiliary exhaust gas runner 309.

The auxiliary exhaust gas runner 309 may be formed by connecting two first exhaust gas runners 301, and each second exhaust gas runner 303 may be connected to at least one auxiliary exhaust gas runner 309.

For example, auxiliary exhaust gas runners may be applied to DOHC engines having two exhaust valves disposed to each cylinder.

More particularly, the second exhaust gas runners 303 may be connected to two auxiliary exhaust gas runners 309, and each third exhaust gas runner 305 may be connected to two second exhaust gas runners 303.

According to an exemplary embodiment of the present invention, the first, second, and third exhaust gas runners 301, 303, and 305 may be formed inside the cylinder head 307.

As discussed above, the present invention provides an exhaust system that improves the layout, simplifies the manufacturing process and reduces the manufacturing cost.

In addition, exhaust systems of the present invention can discharge exhaust gases more efficiently and reduce the amount of heat release from the exhaust manifold.

While this invention has been described in connection with what is presently considered to be a practical exemplary embodiment, it is to be understood that the invention is not limited to the disclosed embodiment, but, on the contrary, is intended to cover various modifications and equivalent arrangements included within the spirit and scope of the appended claims.

What is claimed is:

1. An exhaust system for discharging combusted gases from a vehicle engine, which comprises an exhaust manifold with a plurality of exhaust gas runners, wherein the plurality of exhaust gas runners include (a) a plurality of first exhaust gas runners each being connected to a corresponding exhaust valve of a corresponding cylinder, (b) a plurality of second exhaust gas runners each being connected to corresponding two or more of the first exhaust gas runners, and (c) at least one third exhaust gas runner each being connected to corresponding two or more of the second exhaust gas runners and connected to a cylinder head of the vehicle engine;

wherein the plurality of exhaust gas runners are arranged so that the exhaust gas can sequentially pass the first exhaust gas runners, the second exhaust gas runners, and the third exhaust gas runner or runners to be discharged and are spaced so as to avoid an exhaust gas interference, and wherein the plurality of exhaust gas runners are formed inside the cylinder head.

2. The system of claim 1, wherein each second exhaust gas runner is connected with two first exhaust gas runners.

3. The system of claim 1, wherein each third exhaust gas runner is connected with two second exhaust gas runners.

4. The system of claim 1, wherein the exhaust manifold further comprises at least one auxiliary exhaust gas runner between the first exhaust gas runners and the second exhaust gas runners.

5. The system of claim 4, wherein each second exhaust gas runner is connected to at least one auxiliary exhaust gas runner.

6. The system of claim 5, wherein each second exhaust gas runner is connected to two auxiliary exhaust gas runners.

7. The system of claim 1, wherein each of the plurality of second exhaust gas runners is connected to two of the first exhaust gas runners corresponding thereto, and the third exhaust gas runners or each of the third exhaust gas runners is connected to two of the second exhaust gas runners corresponding thereto.

8. A motor vehicle comprising the exhaust system of claim 1.

* * * * *